US006984479B2

(12) United States Patent
Yamazaki

(10) Patent No.: US 6,984,479 B2
(45) Date of Patent: Jan. 10, 2006

(54) ELECTROPHOTOGRAPHIC PHOTOCONDUCTOR AND MANUFACTURING METHOD THEREFORE

(75) Inventor: Mikio Yamazaki, Nagano (JP)

(73) Assignee: Fuji Electric Imaging Device Co., Ltd., Nagano (JP)

( * ) Notice: Subject to any disclaimer, the term of this patent is extended or adjusted under 35 U.S.C. 154(b) by 0 days.

(21) Appl. No.: 10/128,986

(22) Filed: Apr. 24, 2002

(65) Prior Publication Data

US 2003/0031944 A1 Feb. 13, 2003

(30) Foreign Application Priority Data

Apr. 27, 2001 (JP) ..... 2001-132114
Jul. 26, 2001 (JP) ..... 2001-225391

(51) Int. Cl.
*G03G 5/06* (2006.01)

(52) U.S. Cl. ..... 430/78; 430/59.5

(58) Field of Classification Search ..... 430/78, 430/59.5, 59.4

See application file for complete search history.

(56) References Cited

U.S. PATENT DOCUMENTS

| | | | | |
|---|---|---|---|---|
| 2,297,691 A | | 10/1942 | Carlson | |
| 3,816,118 A | | 6/1974 | Byrne | |
| 3,825,422 A | | 6/1974 | Gruber et al. | |
| 4,728,592 A | * | 3/1988 | Ohaku et al. | 430/78 |
| 4,963,452 A | * | 10/1990 | Kinoshita | 430/78 |
| 5,821,021 A | * | 10/1998 | Kawahara | 430/78 |

FOREIGN PATENT DOCUMENTS

| | | |
|---|---|---|
| JP | 53-89433 A1 | 8/1978 |
| JP | 57-148745 A1 | 9/1982 |
| JP | 01097965 | 4/1989 |
| JP | 04095964 | 3/1992 |
| JP | 04198367 | 7/1992 |
| JP | 07247441 | 9/1995 |
| JP | 08-209023 A1 | 8/1996 |
| JP | 00147811 | 5/2000 |

OTHER PUBLICATIONS

Toguchi, Satoru et al. Novel Crystals of Titanium Oxide Phthalocyanine with Submicron Diameter. JIST vol. 43, No. 5, pp. 420 424 (1999).*

Borsenbergerm Pauk M. et al. ; "Organic Photoreceptors for Imaging Systems"; (ISBN 0-8247-8926-1); 1993 Marcel Dekker, Inc.); v. 39; pp 430-439.

Hiller, Wolfgang et al.; "Polymorphie, Lietfahigkeit und Kristallstrukturen von Oxo-phthalcocyaninato-titan (IV"; Zeitschrift fur Kristallographie 159, 173-183 (1982); by Akademische Verlagsgesellschaft 1982.

Rigaku Corporation; "A Guide to X-ray Diffractometry"; Analysis Center of Rigaku, 4th ed. Dec. 30, 1986, pp. 75-79 (In Japanese).

Translation of "A Guide to X-ray Diffractometry".

* cited by examiner

*Primary Examiner*—Christopher Rodee
(74) *Attorney, Agent, or Firm*—Darby & Darby

(57) ABSTRACT

An electrophotographic photoconductor includes a photosensitive layer on a conductive substrate. The photosensitive layer contains a pigment that consists of crystallites composed of molecules having a titanylphthalocyanine structure, wherein a crystallite diameter of the pigment is not smaller than 20 nm and a primary particle diameter of the pigment is not larger than 500 nm.

3 Claims, 1 Drawing Sheet

ELECTROPHOTOGRAPHIC PHOTOCONDUCTOR AND MANUFACTURING METHOD THEREFORE

BACKGROUND TO THE PRESENT INVENTION

1. Field of the Invention

The present invention relates to an electrophotographic photoconductor. More particularly, the present invention relates to a photoconductor that exhibits improved charge retention rate in the dark and exhibits additional desirable charging characteristics including stability of potential in repeated use and diminished image defects. The invention may be favorably applied to an electrophotographic photoconductor that is used in an electrophotographic apparatus employing discharged-area development process system.

2. Description of the Related Art

Many business machines employ a type of image formation based on electrophotographic technology. These business machines include copiers, printers, plotters, and composite digital imaging systems which combine functions of several such machines.

Recently, this imaging technology has been widely applied to small-sized printers and facsimile machines. Since Carlson's invention (U.S. Pat. No. 2,297,691), a wide variety of photoconductors have been developed for electrophotographic apparati, in which photoconductors employing organic material have been commonly used.

In known function-separated organic photoconductors, laminates, on a conductive substrate include an undercoat layer of an anodic oxide film or a resin film, a charge generation layer containing photoconductive organic pigment such as titanylphthalocyanine or azo pigment, a charge transport layer containing a molecule with a partial structure involved in hopping conduction of electric charges. Examples of such molecules including amine and hydrazone that is combined with a $\pi$-electron-conjugated system, and a protective layer.

Known photoconductors also include single-layer photoconductors that comprise a photosensitive layer, functioning as both charge generator and charge transporter, laminated on an undercoat layer, and a protective layer if necessary.

Electrophotographic apparatuses in recent years commonly employ a discharged-area development process, in which digital signals of pictures and characters are transformed to optical signals using a light source of a semiconductor laser or a light emitting diode with a wave length of from 450 nm to 780 nm. Here, the optical signals illuminate a charged photoconductor to form a latent image on the photoconductor surface, and the latent image is then visualized using toner powder.

Organic pigments composed of a phthalocyanine have been extensively studied recently as a material for use in a photosensitive layer, because that material exhibits large absorption coefficient in the above-mentioned wavelength range of a semiconductor laser, and since as compared with other charge generation substances, the material has excellent charge generating capability.

Photoconductors are known that use, in addition to the phthalocyanine having a central metal of titanium, a phthalocyanine having a central metal of copper, aluminum, indium, vanadium, as disclosed in Japanese Unexamined Patent App. Pub. Nos. S53-89433 and S57-148745, and U.S. Pat. Nos. 3,816,118 and 3,825,422.

In recent years, the phthalocyanine having a central metal of titanium is used by preference because the material exhibits large absorption coefficient and high sensitivity in the wavelength range of a semiconductor laser.

Unlike a charged-area development process, in the above-mentioned discharged-area development process, a dark potential corresponds to a white portion and a bright potential corresponds to a black portion of an image. Therefore, if the photosensitive layer laminated on the conductive substrate includes an organic pigment particle for charge generation with extremely large size, an image defect such as a black spot or a fog in a white matrix may unfortunately be generated.

This kind of undesirable defect is believed to be caused by minute leakage of electric charges from the conductive substrate through the large-sized pigment particle to the surface of the photosensitive layer; this leakage in turn causing local decrease of electric potential.

An electrophotographic apparatus that employs both discharged-area development and contact charging, in particular, in which the photoconductor directly contacts with a charging member, is unfortunately liable to raise this image defect problem. In order to mitigate this problem, it is known to be effective to form the charge generation layer by means of evaporation method. However, as a further concern, the evaporation method undesirably needs to employ a batch production system, must use expensive vacuum equipment, and requires exposure to a solvent atmosphere after deposition in order to transform to a proper crystal form. Consequently, a method which employs both discharged-area development and contact charging results in high manufacturing costs, which opposes the recent trend of cost reduction and causes serious economic concerns in business.

Additionally, there often arose a problem wherein a photosensitive layer formed from certain lot of coating liquid for a charge generation layer containing titanylphthalocyanine pigment did not exhibit enough charge retention rate in the dark and showed deteriorated charging characteristics after repeated use, although high sensitivity was temporarily achieved.

In Japanese Unexamined Pat. App. Pub. No. H1-97965 an electrophotographic photoconductor exhibiting high sensitivity and excellent characteristics after repeated use was obtained by controlling the crystallite diameter of the diazo compound to be not less than 11 nm. This invention in the publication is limited to the crystallite diameter of the diazo compound. The inventor of the present invention noted the disclosure about the crystallite diameter in the publication when he was investigating the above-described problem of the lot-to-lot variation in the characteristic of the coating liquid containing titanylphthalocyanine pigment.

In Japanese Unexamined Pat. App. Pub. No. 2000-147811 discloses a memory phenomenon wherein, in a printed image, point defects such as black spots or white spots were prevented by controlling the particle size of a metal-free phthalocyanine or a phthalocyanine having a central metal of titanium as a charge generation substance in a single-layer type photosensitive layer to distribute in the range from 0.3 $\mu$m to 2 $\mu$m.

In Japanese Unexamined Pat. App. Pub. Nos. H4-198367 and H4-95964 it is disclosed that electrophotographic characteristics are improved by specifying the relation between the crystal form and the specific surface area and the relation between the crystal form and the particle diameter of a titanylphthalocyanine.

Unfortunately, the above publications do not disclose the improvement of electrical characteristics in a photoconductor by controlling both a crystallite diameter and a primary particle diameter of the titanylphthalocyanine pigment as disclosed in the present invention.

OBJECTS AND SUMMARY OF THE INVENTION

It is an object of the present invention to provide an electrophotographic photoconductor which overcomes the disadvantages described above.

It is another object of the present invention to provide an electrophotographic photoconductor that is preferably used in an electrophotographic process of discharged-area development, and which exhibits diminished image defects, improved charge retention rate in the dark, excellent charging characteristic, and stable repetition potential.

It is another object of the present invention to provide a method for manufacturing the improved electrophotographic photoconductor.

It is another object of the present invention to provide an electrophotographic photoconductor for use in an electrophotographic process of contact electrification and which generates reduced image defects.

It is another object of the invention to provide a method for manufacturing such an electrophotographic photoconductor which reduces images defects.

Briefly stated, the present invention relates to an electrophotographic photoconductor including a photosensitive layer on a conductive substrate. The photosensitive layer contains a pigment that consists of crystallites composed of molecules having a titanylphthalocyanine structure, wherein a crystallite diameter of the pigment is not smaller than 20 nm and a primary particle diameter of the pigment is not larger than 500 nm. The ratio of the diameter of the primary particle formed from the crystallite to the diameter of the crystallite is not smaller than 12.

According to an embodiment of the present invention, there is provided, an electrophotographic photoconductor comprising: a conductive substrate, and a photosensitive layer on the conductive substrate, and the photosensitive layer containing a pigment being a plurality of crystallites composed of molecules having a titanylphthalocyanine structure, wherein a diameter of the crystallite is not smaller than 20 nm and a diameter of a primary particle of the pigment is not larger than 500 nm.

According to an embodiment of the present invention, there is provided, an electrophotographic photoconductor wherein a diameter of the primary particle is not larger than 300 nm.

According to an embodiment of the present invention, there is provided, an electrophotographic photoconductor wherein the photosensitive layer contains titanylphthalocyanine pigment having diffraction peaks in an X-ray diffraction chart measured by means of a focusing method with an X-ray of Cu Kα line at Bragg angles 2θ±0.2° of 7.5°±0.2°, 10.2°±0.2°, 16.2°±0.2°, 22.5°±0.2°, 24.20±0.2°, 25.3°±0.2°, and 28.60±0.2°.

According to an embodiment of the present invention, there is provided, an electrophotographic photoconductor wherein the photoconductor is used in an electrophotographic apparatus employing an electrophotographic process of discharged-area development during a use.

According to an embodiment of the present invention, there is provided, an electrophotographic photoconductor wherein the photoconductor is used in an electrophotographic apparatus further employing an electrophotographic process of contact electrification during the use.

According to an embodiment of the present invention, there is provided, a method for manufacturing an electrophotographic photoconductor comprising the steps of: forming a photosensitive layer on a conductive substrate from a coating liquid, wherein the coating liquid is adjusted to have a diameter of a plurality of crystallites, composed of molecules having a titanylphthalocyanine structure, of not smaller than 20 nm and a diameter of a primary particle of a pigment composed of the plurality of crystallites of not larger than 500 nm, during a process of crystal transformation after synthesizing the titanylphthalocyanine structure to transform the titanylphthalocyanine into a crystal form, and wherein the coating liquid has diffraction peaks in an X-ray diffraction chart measured by means of a focusing method with an X-ray of Cu Kα line at Bragg angles 2θ±0.2° of 7.5±0.2°, 10.2°±0.2°, 16.2°±0.2°, 22.5°±0.2°, 24.2°±0.2°, 25.3°±0.2°, and 28.6°±0.2°.

To solve the above problems, the inventor of the present invention has made intense studies in selecting a titanylphthalocyanine pigment, and in particular, titanylphthalocyanine pigments having a specific crystal form as a charge generating material and giving further specific attention to the relation between the sizes of a crystallite and a primary particle of the material and the characteristics of electrical properties and image formation, all in an effort to reach a beneficial settlement of the above problems, which resulted in the accomplishment of the present invention.

According to another embodiment of the present invention there is provided an electrophotographic photoconductor which avoids image defects that emerge when the diameter of the primary particle is larger than 500 nm. A photoconductor of the present invention subsequently also prevents an insufficient charge retention rate in the dark and inferior characteristic in repeated charging, which are both likely to occur when the crystallites are not grown to an enough diameter, namely not smaller than 20 nm, in the crystallization process of the titanylphthalocyanine pigment.

In a further embodiment of the present invention, is beneficially provided that the diameter of the primary particle is preferably not larger than 300 nm.

Advantageously, the photosensitive layer of an embodiment of the present invention contains titanylphthalocyanine pigment having diffraction peaks in an X-ray diffraction chart measured by means of a focusing method with an X-ray of Cu Kα line at Bragg angles 2θ±0.2° of 7.5°±0.2°, 10.2°±0.2°, 16.2°±0.2°, 22.5°±0.2°, 24.2°±0.2°, 25.3°±0.2°, and 28.6°±0.2°.

Preferably, an electrophotographic photoconductor of the present invention may be used in an electrophotographic apparatus employing an electrophotographic process of discharged-area development or contact electrification, or both.

It is specifically noted that the present invention shall not be limited to the examples described below.

The above, and other objects, features and advantages of the present invention will become apparent from the following description read in conjunction with the accompanying drawings, in which like reference numerals designate the same elements.

DESCRIPTION OF THE PREFERRED EMBODIMENTS

Figure 1:
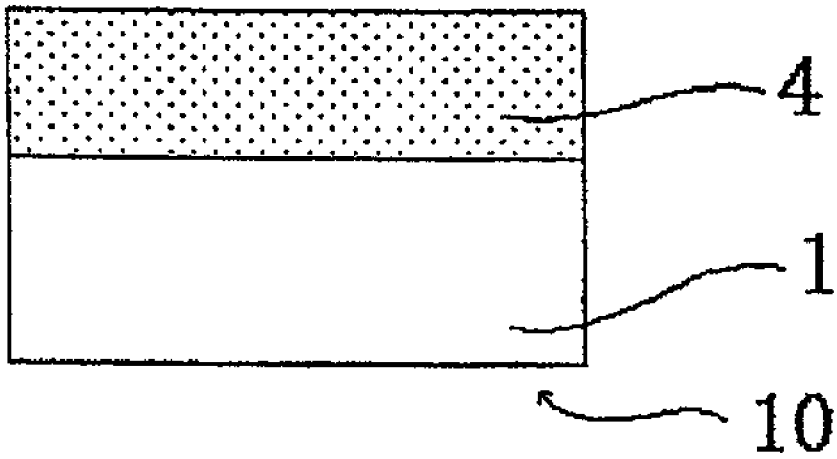
FIG. 1 is a cross-sectional view of an embodiment of the present invention
Figure 2:
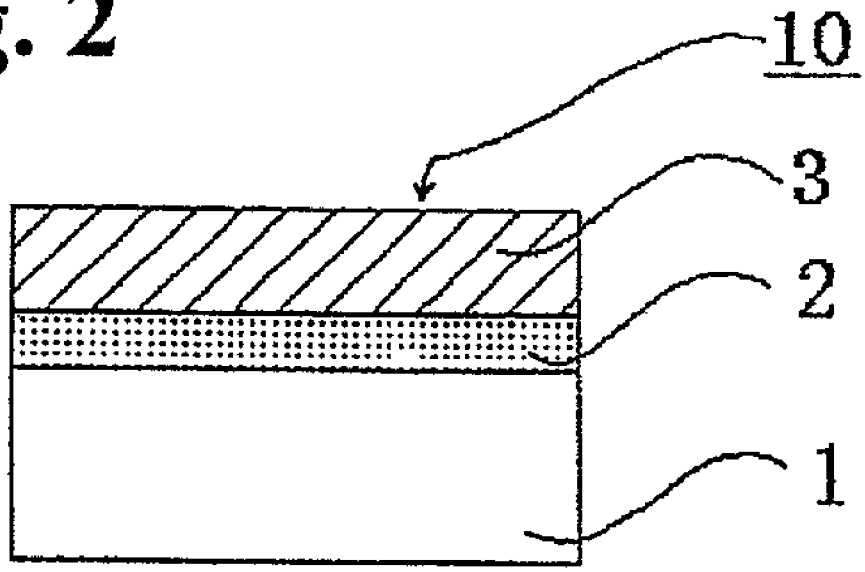
FIG. 2 is another cross-sectional view of an embodiment of the present invention.

Referring now to FIG. 1 an essential part of an electrophotographic photoconductor 10 includes a conductive substrate 1 and a photosensitive layer 4 formed on a surface of substrate 1 Referring now to FIG. 2 is an essential part of an alternative embodiment of electrophotographic photoconductor 10 includes conductive substrate 1, and a charge generation layer 2 and a charge transport layer 3 that are laminated on the surface of substrate 1 in place of photosensitive layer 4.

Conductive substrate 1 may be formed with a cylindrical tube of metal. For example, conductive substrate 1 may be steel or aluminum, or with film of conductive plastic. Molding or a sheet of insulator material such as glass, acrylic resin, polyamide, or poly(ethylene terephthalate) that is given an appropriate conductivity by forming a metallic electrode, may alternatively be used.

An undercoat layer (not shown) maybe formed on substrate 1 if necessary for processing. An undercoat layer may be provided for the purpose of improving adhesiveness between substrate 1 and either photosensitive layer 4, or in the alternative embodiment, between substrate 1 and charge generation layer 2, thereby improving a surface property of substrate 1, and controlling injection of carriers from substrate 1.

Materials for the undercoat layer (not shown) may be selected from an insulative polymer including casein, poly (vinyl alcohol), poly(vinyl acetal), nylon, melamine, and cellulose, a conductive polymer including polythiophene, polypyrrole, poly(phenylene vinylene), and polyaniline, or these polymers that contain a metal oxide such as titanium dioxide or zinc oxide. Anodization of the substrate surface may also be employed.

Charge generation layer 2 (shown in FIG. 2) may be formed using various titanylphthalocyanine pigments with various crystal morphology having various crystal forms and crystal modifications in combination with a resin binder.

Particularly favorable is titanylphthalocyanine pigment having diffraction peaks in an X-ray diffraction chart measured by means of a focusing method with an X-ray of Cu Kα line at Bragg angles 2θ±0.2° of 7.5°±0.2°, 10.2°±0.2°, 16.2°±0.2°, 22.5°±0.2°, 24.2°±0.2°, 25.3°±0.20°, and 28.6°±0.2°.

Examples of the above-mentioned crystal morphology are α-type titanylphthalocyanine, β-type titanylphthalocyanine, Y-type titanylphthalocyanine, and a titanylphthalocyanine that shows a maximum peak at 9.6 degrees of Bragg angle 2θ on an X-ray diffraction spectrum with Cu Kα line and is disclosed in Japanese Unexamined Pat. App. Pub. No. H8-209023.

Use of these titanylphthalocyanine pigments brings about remarkable improvement in sensitivity, durability, and image quality. In the above-exemplified crystal morphology, the crystal called α-type titanylphthalocyanine and β-type titanylphthalocyanine are considered to be the crystal form of phase II and phase I, respectively, which are involved in the present invention. A plurality of titanylphthalocyanine with various crystal morphology may be used in a mixture of them.

The titanylphthalocyanine pigment used in the present invention are dispersed in resin binder and controlled to a diameter of the primary particle being in the range from 50 nm to 500 nm, and preferably from 150 nm to 300 nm. Since performance of charge generation layer 2 is affected by the resin binder, it is important to select an appropriate one from materials including poly(vinyl chloride), poly(vinyl butyral), poly(vinyl acetal), polyester, poly-carbonate, acrylic resin, and phenoxy resin. The film thickness is preferably in the range from 0.1 to 5 μm, and more preferably from 0.2 to 0.5 μm.

In order to attain excellent dispersion condition and to form a homogeneous charge generation layer 2, selection of solvent of the coating liquid is also important. The solvent used in the present invention may be selected from an aliphatic hydrocarbon halide such as methylene chloride or 1,2-dichloroethane, a hydrocarbon ether such as tetrahydrofuran, a ketone such as acetone, methyl ethyl ketone, or cyclohexanone, and an ester such as ethyl acetate or ethyl cellosolve.

It is preferable to adjust the relative contents of the charge generating substance and the resin binder in the coating liquid such that the content of the resin binder in charge generation layer 2 is in a range from 30 to 70 weight percent after application and drying.

In a most preferable composition of charge generation layer 2, the quantity of charge generating substance is 50 parts by weight with respect to 50 parts by weight of the resin binder.

The coating liquid is prepared by appropriately mixing the above-mentioned substances. It is important to prepare coating liquid in which pigment is homogeneously dispersed in the binder resin using a dispersion machine such as a bead mill or a paint shaker. Moreover, it is critical to control the primary particles of the pigment in growth to a desired diameter and to supply the same to the coating.

Charge transport layer 3 is formed by applying charge a transport substance only or a coating liquid prepared by dissolving the charge transport substance and binder resin in a suitable solvent, onto charge generation layer 2 by means of a dip-coating method, a method using an applicator, or other methods, and drying.

A hole-transport substance, electron-transport substance, or a mixture of both is used as a charge transport substance corresponding to a method for charging photoconductor 10.

Such a substance may be selected from the known substances that are exemplified by: Borsenberger, P. M. and Weiss, D. S. eds., "Organic Photoreceptors for Inaging Systems" Marcel Dekker Inc. (1993).

The known hole-transport substances include a hydrazone compound, a pyrazoline compound, a pyrazolone compound, an oxadiazole compound, an oxazole compound, and arylamine compound, a benzidine compound, a stylbene compound, a styryl compound, poly-vinylcarbazole, and a polysilane. These hole-transport substances may be used alone or combining two or more substances.

The known electron-transport substances, which are acceptor type compounds, includes succinic anhydride, maleic anhydride, dibromosuccinic anhydride, phthalic anhydride, 3-nitrophthalic anhydride, 4-nitrophthalic anhydride, pyromellitic anhydride, pyromellitic acid, trimellitic acid, trimellitic anhydride, phthalimide, 4-nitrophthalimide, tetracyanoethylene, tetracyanoquinodimethane, chloranyl, bromanyl, o-nitrobenzoic acid, malononitrile, trinitrofluorenone, trinitrothioxanthone, dinitrobenzene, dinitroanthracene, dinitroacridine, nitroanthraquinone, dinitroanthraquinone, thiopyran compound, quinone compound, benzoquinone compound, diphenoquinone compound, naphthoquinone compound, anthraquinone compound, stilbenequinone compound, and a azoquinone compound.

These electron-transport substances may be used alone or in a suitable combination of two or more substances.

For the binder resin to form charge transport layer 3, in combination with the 110 charge transport substance, polycarbonate polymers are widely used in view of film strength and wear resistance. These polycarbonate polymers include bisphenol A, bisphenol C, and bisphenol Z. A copolymer containing monomer units composing these types of bisphenol may also be employed. A preferable molecular weight of these polycarbonate polymers is in the range from 10,000 to 100,000.

In addition to the polycarbonate polymers, the binder resin for charge transport layer 3 may be selected from polyethylene, polyphenylene ether, acrylic, polyester, polyamide, polyurethane, epoxy, poly(vinyl acetal), poly(vinyl butyral), phenoxy resin, silicone resin, poly(vinyl chloride), poly(vinylidene chloride), poly(vinyl acetate), cellulose resin, and copolymers of these substances.

Film thickness for charge transport layer 3 are preferably in the range from 3 to 50 $\mu$m considering desirable (customer driven) charging characteristics and wear resistances of photoconductor 10. To give smoothness to the surface, silicone oil may be added. An additional surface protective layer may be provided on the charge transport layer 3 if necessary.

Photosensitive layer 4 is a single layer, which is mainly composed of a charge generation substance, a hole-transport substance, an electron transport substance, which is an acceptor type compound, and a resin binder.

As the charge generation substance, the above-described various crystal morphologyies of titanylphthalocyanine pigments may be used alone or in combination of two or more substances.

Favorable content of the titanylphthalocyanine pigment is in the range from 0.1 to 20 wt %, and more preferably from 0.5 to 10 wt %, with respect to the solid component of the photosensitive layer.

Hole-transport substances may be selected from those materials listed earlier. Hole-transport substances may be used alone or in combinations of two or more substances. The hole-transport substance that is preferably used in the present invention need not only excel in the transport ability of holes generated upon receipt of light, but must function as an appropriate combination with the charge generation substance. Content of the hole-transport substance in the photosensitive layer is in the range from 5 to 80 wt %, and preferably from 10 to 60 wt % with respect to the solid components of the layer.

Electron-transport substances may also be selected from those materials listed earlier. The electron-transport substance may be used alone, or in combinations of two or more substances. The content of the electron-transport substance is in the range from 1 to 50 wt %, and preferably from 5 to 40 wt % with respect to the solid components of the photosensitive layer.

Binder resin for photosensitive layer 4 may be selected from the polymer resins listed earlier. The content of the binder resin in photosensitive layer 4 is preferably in the range from 10 to 90 wt %, and more preferably in the range from 20 to 80 wt % with respect to the solid components of the layer.

Film thickness for photosensitive layer 4 are preferably in a range from 3 to 100 $\mu$m, and more preferably from 10 to 501$\mu$m, in order to maintain practically effective surface potential.

For the purpose of improving resistance to the environment and stability against harmful light, the photosensitive layer may contain an agent for degradation prevention such as an antioxidant or a light stabilizer.

A compound used for this purpose may be selected from a chromanol derivative such as tocopherol and an esterified compound thereof, a poly(aryl alkane) compound, a hydroquinone derivative, an ether compound, a diether compound, a benzophenone derivative, a benzotriazole derivative, a thioether compound, a phenylenediamine derivative, a phosphonate, a phenol compound, a hindered phenol compound, a linear amine compound, a cyclic amine compound, and a hindered amine compound.

The photosensitive layer may also contain a leveling agent such as silicone oil or fluorine oil for the purpose of improving flatness of the formed film and for providing the film with a desirable lubricating ability.

For the purpose of reducing friction coefficient and giving lubricity, the photosensitive layer may further contain fine particles of a metal oxide such as silicon oxide, that is silica, titanium oxide, zinc oxide, calcium oxide, aluminum oxide, that is alumina, or zirconium oxide, a metal sulfate such as barium sulfate or calcium sulfate, a metal nitride such as silicon nitride or aluminum nitride, particles of a fluororesin such as polytetrafluoroethylene resin, or a fluororesin of comb-type graft copolymer. Other known additives may be contained, if necessary.

Where desired, a protective layer may be provided for the purpose of improving durability to repeated printings. The protective layer may be an organic thin film of mainly binder resin or an inorganic thin film of amorphous carbon. The binder resin of the protective layer may contain, for the purpose of raising conductivity, reducing friction coefficient, and for the purpose of offering lubricity, fine particles of a metal oxide such as silicon oxide, that is silica, titanium oxide, zinc oxide, calcium oxide, aluminum oxide, that is alumina, or zirconium oxide, a metal sulfate such as barium sulfate or calcium sulfate, a metal nitride such as silicon nitride or aluminum nitride, particles of a fluororesin such as polytetrafluoroethylene resin, or a fluororesin of comb-type graft copolymer.

The protective layer may also contain a hole-transport substance or an electron-transport substance, as in photosensitive layer 4, for the purpose of giving charge transport ability, or a leveling agent such as a silicone oil or a fluorine oil for the purpose of improving flatness and offering lubricity to the formed film. Other known additives may be contained, if necessary.

The present invention will be described with reference to some examples of the preferred embodiments of the present invention. However, the invention shall not be limited to the examples described below.

EXAMPLE 1

A conductive substrate 1 as an aluminum drum was coated with a coating liquid by a dip-coating method and dried at 145° C. for 30 min to form an undercoat layer of 1.5 $\mu$m thickness.

The coating liquid for the undercoat layer was prepared by dispersing 2.5 parts by weight of a vinyl phenolic resin (Maruka lyncur MH-2 manufactured by Maruzen Petrochemical Co., Ltd.), 2.5 parts by weight of a melamine resin (UVAN 20 HS manufactured by Mitsuitoatsu Chemicals Co., Ltd.), and 5 parts by weight of fine particles of aminosilane-treated titanium oxide in 75 parts by weight of methanol and 15 parts by weight of butanol.

Thereafter, 5 liters of slurry was prepared by adding 2 parts by weight of titanylphthalocyanine to a solution dissolving 1 part by weight of poly(vinyl butyral) resin in 98 parts by weight of tetrahydrofuran.

The titanylphthalocyanine had a crystal form classified as phase II that was studied by Hiller et al. (W. Hiller et al., Z. Kristallogr. 159 p. 173 (1982)); and had diffraction peaks in an X-ray diffraction chart measured by means of a focusing method with an X-ray of Cu Kα line at Bragg angles 2θ±0.2° of 7.5°±0.2°, 10.2±0.2°, 16.2°±0.2°, 22.5°±0.2°, 24.2°±0.2°, 25.3°±0.2°, and 28.60±0.2°. The diameter of crystallites of the titanylphthalocyanine was selected to be not smaller than 20 nm.

Dispersion liquid, that is a coating liquid for a charge generation layer, was prepared by conducting dispersion treatment on the slurry using a bead mill in order to adjust the diameter of the primary particle of the titanylphthalocyanine in the slurry to be not larger than 500 nm.

The dispersion treatment was conducted using a disk-type bead mill containing zirconia beads having a diameter of 0.8 mm at a filled ratio of 85 vol % with respect to the vessel capacity. The treatment was conducted at 20 passes with a flow rate of the processing slurry of at 400 ml/min and peripheral velocity of 3 m/s. The above-described aluminum drum, having an undercoat layer, was dip-coated with thus prepared coating liquid such that the film thickness became 0.2 μm after drying. The drying was conducted at 100° C. for 15 min to form charge generation layer 2.

Each of the crystallites of the titanylphthalocyanine adjusted to a specified diameter is a microscopic crystal that may be regarded as a single crystal. The crystallites are formed by proceeding crystallization that accompanies crystal transformation, by means of ball mill treatment of the crude material of the amorphous phthalocyanine which has been generated in advance by a synthesis reaction.

The diameter of the crystallite may be controlled by varying the conditions for the ball mill treatment. The condition for the ball mill treatment in this specific example was to conduct a wet ball mill treatment using a tetrahydrofuran (THF) solvent for 12 hr.

In the present invention, a primary particle is a particle that has coagulated to a specified size by treating the titanylphthalocyanine crystallites in the binder resin solution using a bead mill. The diameter of the primary particle may be controlled by adjusting number of passes through the bead mill.

In the dispersion treatment, that is the bead mill treatment, to form coating liquid in which the primary particles of the titanylphthalocyanine are homogeneously dispersed, the primary particles may aggregate to form a particle, which is called a secondary particle in some cases.

Formation of the secondary particles may cause the coating liquid to become unstable, and image defects are likely to be generated. Consequently, the secondary particles are not desirable, and development of the same is discouraged.

Coating liquid for a charge transport layer was prepared by dissolving 9 parts by weight of a stylbene compound represented by the chemical structural formula (I) as a charge transport substance and 11 parts by weight of a polycarbonate resin as a binder resin (TOUGHZET B-500 manufactured by Idemitsu Kosan Co., Ltd.) in 55 parts by weight of dichloromethane solvent. In formula (I), symbols of elements C and H are omitted. A charge transport layer 3, of the present example, having thickness of 25 μm was formed by dip-coating with this coating liquid and drying at 90° C. for 60 min. Thus, an electrophotographic photoconductor 10 was produced.

(I)

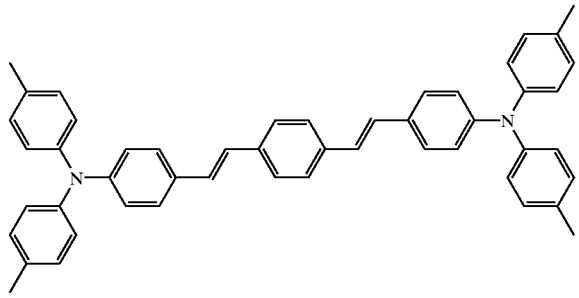

The diameter of the crystallite of the titanylphthalocyanine pigment is determined by the following measurement. The coating liquid for the charge generation layer is applied onto an aluminum plate to form a film with thickness of about 500μm. A sample for X-ray diffraction is obtained by drying this material at 80° C. for 30 min. The sample was then mounted on an X-ray diffraction set in the optical arrangement of the focusing method (that is one of the methods of powder method X-ray diffractometry) to obtain an X-ray diffraction chart. The diameter of the crystallite is calculated by analyzing the diffraction chart using the commonly known Scherrer's formula (II) below.

$$\varepsilon = K\frac{\lambda}{\beta_i \cos\theta} \quad \text{(II)}$$

Here, ε represents a diameter of a crystallite (nm), λ: a wavelength of the incident X-ray (nm), $\beta_i$ (rad): a half-width of a diffraction peak at a diffraction angle θ, K: a constant depending on a readout method of the half-width, for example, K=1 when an integral width is used, θ: a diffraction angle.

This formula is considered valid in a diameter range of from 1 to 100 nm. Details of practical analysis procedure is disclosed in a document "A guide to X-ray diffractometry" edited by the Analysis Center of Rigaku Co., Ltd., $4^{th}$ revised edition, 1986.

The numerical value of the crystallite diameter of the above-described charge generation substance, of the titanylphthalocyanine pigment measured by this method, was 25 nm.

A diameter of a primary particle of a charge generation substance of titanylphthalocyanine pigment is determined by the method describe below.

A coating liquid for the charge generation layer is diluted to suitable concentration and applied onto a smooth surface such as silicon wafer, and then dried.

On the surface of the resulted article, a platinum-palladium alloy, for example, is deposited with a thickness of not more than 5 nm so as to give a selected conductivity. The obtained specimen is observed under a scanning electron microscope, and a secondary electron image of the specimen surface is taken.

Image analysis is performed on the secondary electron image to obtain a particle size distribution chart, which is transformed to a cumulative frequency under size distribution curve. The diameter of the primary particle is the diameter $D_{50}$ (nm) at a 50% point of the cumulative frequency under the size distribution curve.

When the coating liquid exhibits adequate dispersion, and does not form a secondary particle that may be formed by aggregated primary particles, the diameter of the primary particle may be measured by a commercially available particle size analyzer that adapts a dynamic light-scattering method.

If aggregation is observed, the primary particles are distinguished from the secondary particles, that are formed by flocculation of the primary particles, by observation under an electron microscope. This measuring method gave a value of 220 nm for the diameter $D_{50}$ of the primary particle of the titanylphthalocyanine pigment. The calculated ratio of the diameter of the primary particle (220 nm) formed from the crystallite to the diameter of the crystallite (25 nm) is 8.8.

The following examples and comparative examples describe the production of a photoconductor 10 in the same manner as Example 1. However, the duration of the ball mill treatment, the number of passes through the bead mill, or some other parameter was varied. For each result the ratio of the diameter of the primary particle formed from the crystallite to the diameter of the crystallite is calculable. Table 1 summarizes the results and ratios obtained from these examples and comparative examples.

EXAMPLE 2

A photoconductor was produced in the same manner as in Example 1, except that the duration of the ball mill treatment was 24 hr to give a crystallite diameter of 50 nm, and the number of passes through the bead mill was 25, to result in a diameter for the primary particle of the titanylphthalocyanine pigment in the coating liquid, for the charge generation layer, of 250 nm.

EXAMPLE 3

A photoconductor was produced in the same manner as in Example 1, except that the duration of the ball mill treatment was 36 hr to give a crystallite diameter of 75 nm, and the number of passes through the bead mill was 30, to result a diameter of the primary particle of the titanylphthalocyanine pigment of 270 nm.

COMPARATIVE EXAMPLE 1

A photoconductor 10 was produced in the same manner as in Example 1 except that the ball mill treatment was a dry process and for 36 hr to give a crystallite diameter of 15 nm. The diameter of the primary particle of the titanylphthalocyanine pigment was 190 nm.

COMPARATIVE EXAMPLE 2

A photoconductor 10 was produced in the same manner as in Example 1 except that the number of passes through the bead mill was 10, to give a diameter of the primary particle as 550 nm.

EXAMPLE 4

A photoconductor was produced in the same manner as in Example 1, except that the ball mill treatment used quinoline to obtain titanylphthalocyanine having a crystallite diameter of 20 nm, and the crystal form called β type, classified as phase I as was studied by Hiller et al. The diameter, of the primary particle of the β type titanylphthalocyanine pigment in the coating liquid for the charge generation layer, was 230 nm.

EXAMPLE 5

A photoconductor was produced in the same manner as in Example 4, except that the ball mill treatment used quinoline to obtain the β type titanylphthalocyanine, having a crystallite diameter of 35 nm, and the crystal form classified as phase I, as studied by Hiller et al. The diameter, of the primary particle of the β type titanylphthalocyanine pigment in the coating liquid for the charge generation layer, was 245 nm.

EXAMPLE 6

A photoconductor was produced in the same manner as in Example 4, except that the ball mill treatment used quinoline to obtain the β type titanylphthalocyanine, having a crystallite diameter of 65 nm and the crystal form classified as phase I, as was studied by Hiller et al. The pass number through the bead mill was 30 passes to result a diameter, of the primary particle of the β type titanylphthalocyanine pigment, of 275 nm.

COMPARATIVE EXAMPLE 3

A photoconductor was produced in the same manner as in Example 4, except that the ball mill treatment was conducted by a dry process and for 3 hr to give a crystallite diameter of 12 nm. The diameter, of the primary particle of the β type titanylphthalocyanine pigment, was 200 nm.

COMPARATIVE EXAMPLE 4

A photoconductor 10 was produced in the same manner as in Example 4 except that the number of passes through the bead mill was 10, to give a diameter of the primary particle of 580 nm.

Evaluation Method

Electrophotographic characteristics of the photoconductors produced in the Examples 1 through 6, and Comparative Examples 1 through 4, were evaluated in the following way.

The photoconductor surface was charged to −600 V by corona discharge in the dark using a scorotron charger. A surface potential $V_0$ was measured at the time of stopping the charging. The surface potential $V_5$ was measured after holding the photoconductor in the dark for 5 sec since the end of charging. The potential retention rate $V_{k5}$ (%) at 5 sec after the end of charging, defined by the formula (III), below was obtained.

$$V_{k5} = \frac{V_5}{V_0} \cdot 100 \tag{3}$$

Exposure light at 780 nm, separated from the light source of a halogen lamp using a bandpass filter, was irradiated with the radiation density of 1.0 $\mu$W cm$^{-2}$, on the photoconductor's surface. Such exposure light was irradiated for 5 sec from the time at which the surface potential was −600 V. The exposure light energy that was irradiated until the surface potential attenuated to −100 V was measured as sensitivity $E_{100}$ ($\mu$J cm$^{-2}$).

A fatigue test in repeated use was also performed as follows.

Electrophotographic processes were arranged along the periphery of the photoconductor drum such that a charging roller, an exposure light source, a transferring roller, and an erasing light source were arranged at 45° intervals.

Conditions of the electrophotographic processes were: initial charged potential on the drum surface, −600 V;

intensity of the exposure light at the wavelength of 780 nm, 1 $\mu$W $cm^{-2}$; transferring voltage, +1 kV; intensity of the erasing light at the wave length of 630 nm, 5 $\mu$W $cm^{-2}$; and peripheral speed, 60 mm/s.

The fatigue test was performed by repeating 5,000 cycles. Variation of the charged potential in the dark $\Delta V_0$, after the fatigue test as compared with the initial value and variation of the post-exposure surface potential $\Delta V_1$, were obtained and shown in Table 1 (below) together with the initial characteristics.

Evaluation of image quality was performed by an electrophotographic apparatus that allows image formation by a discharged-area development process. This apparatus was a commercially available printer of a contact charging system that was remodeled by installing a charging device capable of dc voltage charging, dc-ac superimposed voltage charging, or scorotron charging.

Image samples were taken on the photoconductors of Examples and Comparative Examples at the finish of the above-described measurement. The ambient conditions were the temperature of 35° C. and relative humidity of 80%. The charging devices used were a charger with a charging roller of silicone resin and a scorotron charger.

When a charging roller was utilized, the image data was taken in two cases. In the first case, dc −1.5 kV was applied by an external power supply, and in the second case, ac 1.4 kV peak-to-peak was superimposed on the dc voltage of −1.5 kV. When a scorotron charger was utilized, the image data were taken in the case where dc −1.5 kV was applied. The results are given in Table 2 (below).

TABLE 1

| | Crystallite diameter (nm) | Primary particle diameter (nm) | Diameter ratio of primary particle to crystallite | $V_{k5}$ (%) | $E_{100}$ ($\mu Jcm^{-2}$) | $\Delta V_0$ (V) | $\Delta V_1$ (V) |
|---|---|---|---|---|---|---|---|
| Example 1 | 25 | 220 | 8.8 | 94.5 | 0.38 | 11 | −10 |
| Example 2 | 50 | 250 | 5.0 | 96.0 | 0.40 | 8 | −5 |
| Example 3 | 75 | 270 | 3.6 | 97.5 | 0.42 | 5 | −3 |
| Comparative Example 1 | 15 | 190 | 12.7 | 86.0 | 0.37 | 23 | −22 |
| Comparative Example 2 | 25 | 550 | 22.0 | 75.0 | 0.35 | 25 | −27 |
| Example 4 | 20 | 230 | 11.5 | 95.5 | 1.20 | 16 | −11 |
| Example 5 | 35 | 245 | 7.0 | 97.0 | 1.22 | 11 | −7 |
| Example 6 | 65 | 275 | 4.2 | 97.5 | 1.25 | 8 | −6 |
| Comparative Example 3 | 12 | 200 | 16.7 | 88.0 | 1.18 | 31 | −25 |
| Comparative Example 4 | 20 | 580 | 29.0 | 83.0 | 1.15 | 33 | −30 |

TABLE 2

| | image quality | | |
|---|---|---|---|
| | dc charging | dc-ac superimposed charging | scorotron charging |
| Example 1 | excellent | excellent | excellent |
| Example 2 | excellent | excellent | excellent |
| Example 3 | excellent | excellent | excellent |
| Comparative Example 1 | Fog | fog | fog |
| Comparative Example 2 | fog, black spots | fog, black spots | fog |
| Example 4 | excellent | excellent | excellent |
| Example 5 | excellent | excellent | excellent |
| Example 6 | excellent | excellent | excellent |

TABLE 2-continued

| | image quality | | |
|---|---|---|---|
| | dc charging | dc-ac superimposed charging | scorotron charging |
| Comparative Example 3 | fog | fog | fog |
| Comparative Example 4 | fog, black spots | fog, black spots | fog |

As is apparent from Table 1, Comparative Examples 1 and 3, in which the crystallite diameter of the pigment of charge generation substance was less than 20 nm, and Comparative Examples 2 and 4, in which the primary particle diameter is larger than 500 nm, exhibit the surprisingly undesirably charge retention rate of less than 90%.

The Comparative Examples 1 through 4 also showed that the variation of the charged potential in the dark after the repetition test $\Delta V_0$ and the variation of the post-exposure surface potential after the repetition test $\Delta V_1$ are both larger than 20 V in absolute values.

Table 2 shows that Comparative Examples 1 through 4 generated image defects such as fog or black spots in every charging system of the dc voltage charging and dc-ac superimposed charging using the charging roller, and the scorotron charging, in addition to the above-described unfavorable electrical characteristics.

In contrast, Examples 1 through 6, in which the crystallite diameter is selected to be not smaller than 20 nm and the primary particle diameter is not larger than 500 nm, exhibited high charge retention rate, and the variation of charged potential in the dark after the repetition test $\Delta V_1$ and the variation of the post-exposure surface potential after the repetition test are both desirably insignificant proving stable electrical characteristics in the Examples as shown in Table 1, while the difference in sensitivity $E_{100}$ ($\mu Jcm^{-2}$) between Examples 1 through 3 and Examples 4 through 6 is clearly observed corresponding to the difference of the crystal forms of phase I and phase II. Further, Table 2 shows that Examples 1 through 6 exhibit satisfactory image quality.

As described so far, an electrophotographic photoconductor of the present invention comprising a photosensitive layer that contains titanylphthalocyanine pigment with a titanylphthalocyanine structure having a crystallite diameter selected to be not smaller than 20 nm and a primary particle diameter selected to be not larger than 500 nm, where the ratio of the nm and a primary particle diameter selected to be not larger than 500 nm, where the ratio of the diameter of the primary particle formed from the crystallite to the diameter of the crystallite is not smaller than 12, exhibits excellent image quality and practically satisfactory electric characteristics of the charge retention rate, the charging characteristic, and stability of the repetition potential.

It should be understood, that an electrophotographic photoconductor according to the present invention comprises a photosensitive layer on a conductive substrate, the photosensitive layer containing pigment that consists of crystallites composed of molecules having a titanylphthalocyanine structure wherein a diameter of the crystallite is selected to be not smaller than 20 nm and a primary particle diameter of the pigment is selected to be not larger than 500 nm, and where the ratio of the diameter of the primary particle formed from the crystallite to the diameter of the crystallite is not smaller than 12.

As a result, the present invention provides an electrophotographic photoconductor which provides diminished image defects and exhibits raised charge retention rate in the dark, improved charging characteristic, and stable repetition potential when used in the electrophotographic process of the discharged-area development system. When used in the electrophotographic process of the contact electrification system, an electrophotographic photoconductor provided by the present invention generates desirably reduced image defects.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An electrophotographic photoconductor comprising:

a conductive substrate;

a photosensitive layer on said conductive substrate; and said photosensitive layer containing a pigment being a plurality of crystallites composed of molecules having a titanylphthalocyanine structure, wherein a diameter of said crystallite is not smaller than 20 nm and a diameter of a primary particle formed from said plurality of crystallites is in the range of 220 nm to 500 nm.

2. An electrophotographic photoconductor, according to claim 1:

wherein a diameter of said primary particle is not larger than 300 nm.

3. An electrophotographic photoconductor, according to claim 2, wherein:

said photosensitive layer contains titanylphthalocyanine pigment having diffraction peaks in an X-ray diffraction chart measured by means of a focusing method with an X-ray of Cu Kα line at Bragg angles 2θ±0.2° of 7.5°±0.2°, 10.2°±0.2°, 16.2°±0.2°, 22.5°±0.2°, 24.2°±0.2°, 25.3°±0.2°, and 28.6°±0.2°.

* * * * *